US009624641B2

(12) United States Patent
Martin et al.

(10) Patent No.: US 9,624,641 B2
(45) Date of Patent: Apr. 18, 2017

(54) WORK TOOL COUPLER FOR A WORK VEHICLE

(71) Applicant: Deere & Company, Moline, IL (US)

(72) Inventors: Kyle T. Martin, Dubuque, IA (US); James Wentzloff, North Ogden, UT (US)

(73) Assignee: Deere & Company, Moline, IL (US)

( * ) Notice: Subject to any disclaimer, the term of this patent is extended or adjusted under 35 U.S.C. 154(b) by 193 days.

(21) Appl. No.: 14/601,950

(22) Filed: Jan. 21, 2015

(65) Prior Publication Data

US 2016/0208455 A1 Jul. 21, 2016

(51) Int. Cl.

| | |
|---|---|
| ***B25G 3/18*** | (2006.01) |
| ***F16B 21/00*** | (2006.01) |
| ***F16D 1/00*** | (2006.01) |
| ***E02F 3/36*** | (2006.01) |

(52) U.S. Cl.

CPC ..... *E02F 3/3627* (2013.01); *E02F 3/364* (2013.01); *E02F 3/3668* (2013.01); *E02F 3/3672* (2013.01); *Y10T 403/595* (2015.01)

(58) Field of Classification Search

CPC ..... Y10T 403/59; Y10T 403/595; Y10T 403/598; Y10T 403/599; Y10T 403/602; Y10T 403/608; E02F 3/3604; E02F 3/3609; E02F 3/3627; E02F 3/3631; E02F 3/3636; E02F 3/3663; E02F 3/3686

USPC ..... 403/321, 322.1, 322.3, 322.4, 324, 325; 37/468, 403; 172/272, 273

See application file for complete search history.

(56) References Cited

U.S. PATENT DOCUMENTS

| | | | | | |
|---|---|---|---|---|---|
| 4,116,346 | A * | 9/1978 | Uchida | E02F 3/3618 | 172/273 |
| 5,415,235 | A * | 5/1995 | Gebauer | A01B 59/048 | 172/272 |
| 5,581,917 | A * | 12/1996 | Barden | E02F 3/3663 | 172/272 |
| 5,727,342 | A * | 3/1998 | Horton | E02F 3/3622 | 37/468 |
| 5,974,706 | A * | 11/1999 | Kaczmarski | E02F 3/3622 | 37/468 |
| 6,409,459 | B1 * | 6/2002 | Ginn | E02F 3/283 | 414/685 |
| 6,773,223 | B2 * | 8/2004 | Harris | E02F 3/3663 | 37/468 |
| 6,866,467 | B2 * | 3/2005 | Dvorak | E02F 3/3663 | 37/468 |
| 7,329,082 | B2 * | 2/2008 | Warren | E02F 3/3659 | 37/468 |

(Continued)

*Primary Examiner* — Gregory Binda
*Assistant Examiner* — Nahid Amiri

(57) ABSTRACT

A work tool coupler for a work vehicle may include a rigid body, a retention pin, a four-bar linkage, and a lever. The retention pin may be configured to engage a work tool when the coupler is in an engaged position. The four-bar linkage may include a first member pivotally connected to the retention pin and at least one of a second member and a third member, the second member pivotally connected to at least one of the first member and the third member, the third member pivotally connected to at least one of the first member and the second member and a fourth member, and the fourth member pivotally connected to the third member. The lever may be attached to the fourth member.

17 Claims, 8 Drawing Sheets

(56) References Cited

U.S. PATENT DOCUMENTS

| | | | | |
|---|---|---|---|---|
| 7,455,494 | B2 * | 11/2008 | Krieger | E02F 3/3645 37/468 |
| 2012/0036838 | A1 | 2/2012 | Furuya | |
| 2012/0128456 | A1 * | 5/2012 | Grimes | E02F 3/96 414/715 |
| 2013/0291523 | A1 | 11/2013 | Shah et al. | |
| 2014/0096419 | A1 * | 4/2014 | Pinther | E02F 3/3627 37/468 |
| 2014/0260199 | A1 | 9/2014 | Grzesiak et al. | |

* cited by examiner

WORK TOOL COUPLER FOR A WORK VEHICLE

FIELD OF THE DISCLOSURE

The present disclosure relates to a machine. An embodiment of the present disclosure relates to a coupler which may attach a work tool to a work vehicle.

BACKGROUND

Work vehicles may utilize work tools such as blades, buckets, and forks in their operations. These work tools may be movably connected to the work vehicle so as to allow the work vehicle to lift, tilt, or rotate the work tool. Certain work vehicles may be configured so as to be compatible with multiple different work tools. These work vehicles may utilize a coupler which may selectively interconnect the work vehicle with one of a number of different work tools. This coupler may be configured with a retention assembly to retain the work tool currently attached to the coupler.

SUMMARY

According to an aspect of the present disclosure, a work tool coupler for a work vehicle may include a rigid body, a retention pin, a four-bar linkage, and a lever. a rigid body. The retention pin may be configured to engage a work tool when the coupler is in an engaged position. The four-bar linkage may include a first member, a second member, a third member, and a fourth member. The first member may be pivotally connected to the retention pin. The first member may also be pivotally connected to at least one of a second member and a third member. The second member may be pivotally connected to at least one of the first member and the third member. The third member may be pivotally connected to at least one of the first member and the second member. The third member may also be pivotally connected to a fourth member. The fourth member may be pivotally connected to the third member. The lever may be attached to the fourth member.

According to another aspect of the present disclosure, the second member may be pivotally connected to the body and the fourth member may be pivotally connected to the body.

According to another aspect of the present disclosure, the pivotal connection between the second member and the body may be located at a distance from the pivotal connection between the fourth member and the body.

According to another aspect of the present disclosure, the work tool coupler may include a pivot pin. The first member, the second member, and the third member may be pivotally interconnected via the pivot pin.

According to another aspect of the present disclosure, the pivotal connection between the first member and the retention pin may be at a first distance from the pivotal connection between the first member and the second member. The pivotal connection between the first member and the second member may be at a second distance from the pivotal connection of the second member and the body. The pivotal connection between the second member and the third member may be at a third distance from the pivotal connection of the third member and the fourth member. The pivotal connection between the third member and the fourth member may be at a fourth distance from the pivotal connection between the fourth member and the body. Each of the first distance, the second distance, the third distance, and the fourth distance may be greater than 0 inches.

According to another aspect of the present disclosure, the four-bar linkage may be configured such that a line of action formed by the pivotal connection of the third member to at least one of the first member and the second member and the pivotal connection of the third member to the fourth member may not cross an axis about which the fourth member is pivotally connected to the body.

According to another aspect of the present disclosure, the four-bar linkage may be configured such that when the coupler is in the engaged position, a line of action formed by the pivotal connection of the first member to the retention pin and the pivotal connection of the first member to the second member is on the opposite side of an axis about which the second member is pivotally connected to the body as the lever.

According to another aspect of the present disclosure, the work tool coupler may include a spring and a cam, wherein the spring is connected to the linkage via the cam.

According to another aspect of the present disclosure, the cam may be located on at least one of the second member and the third member and the spring may extend between the cam and at least one of the first member and the retention pin.

According to another aspect of the present disclosure, the cam and the spring may be configured and positioned so that the length of the spring when the coupler is in an intermediate position between the engaged position and a disengaged position is shorter than the length of the spring when the coupler is in the engaged position or the disengaged position.

According to another aspect of the present disclosure, the spring may be a coil spring and the first member may be located within the spring.

According to another aspect of the present disclosure, the lever may include a means for actuation by hand and a means for actuation by foot.

According to another aspect of the present disclosure, a work tool coupler for a work vehicle may include a rigid body, a four-bar linkage, and a lever. The rigid body may include a ridge positioned on an upper surface of the body and shaped to mate with a depression on a work tool so as to resist forward and rearward movement of the work tool relative to the coupler. The body may also include a slot positioned on a lower surface of the body. The retention pin may be positioned within the slot and shaped to mate with a hole on a work tool so as to resist movement of the work tool relative to the coupler. The four-bar linkage may include a first member, a second member, a third member, and a fourth member. The first member may be pivotally connected to the retention pin about a first point and pivotally connected to a second member and a third member about a second point. The second member may be pivotally connected to the body about a third point. The third member may be pivotally connected to a fourth member about a fourth point. The fourth member may be pivotally connected to the body about a fifth point. The lever may be attached to the fourth member.

According to another aspect of the present disclosure, the retention pin may be in a first position when the coupler is in an engaged position, the retention pin may be in a second position when the coupler is in a disengaged position, and the retention pin may protrude further below the rigid body in the first position than in the second position.

According to another aspect of the present disclosure, the work tool coupler may include a cam, a follower plate, and a coil spring. The cam may be defined by an outer surface of the second member. The follower plate may be in contact with the cam. The coil spring may be held in compression by the follower plate.

According to another aspect of the present disclosure, the first member may be positioned within the coil spring.

According to another aspect of the present disclosure, the cam may be shaped such that the compression of the coil spring is greater when the coupler is in an intermediate position between the engaged position and the disengaged position than when the coupler is in the engaged position.

According to another aspect of the present disclosure, the work tool coupler may include a first surface, a second surface, and a third surface. The first surface of the cam may be positioned between the first point and the second point and in contact with the follower plate when the coupler is in the engaged position. The second surface of the cam may be positioned between the first point and the second point and in contact with the follower plate when the coupler is in an intermediate position between the engaged position and the disengaged position. The third surface of the cam may be positioned between the first point and the second point and in contact with the follower plate when the coupler is in the disengaged position. The first surface may be closer to the second point than the second surface.

According to another aspect of the present disclosure, the third surface may be closer to the second point than the second surface.

According to another aspect of the present disclosure, the four-bar linkage may be configured such that when the coupler is in the engaged position, a line of action formed by the first point and the second point may be on the opposite side of the second third point as the lever.

The above and other features will become apparent from the following description and accompanying drawings.

BRIEF DESCRIPTION OF THE DRAWINGS

The detailed description of the drawings refers to the accompanying figures in which.

Like reference numerals are used to indicate like elements throughout the several figures.

DETAILED DESCRIPTION

Figure 1:
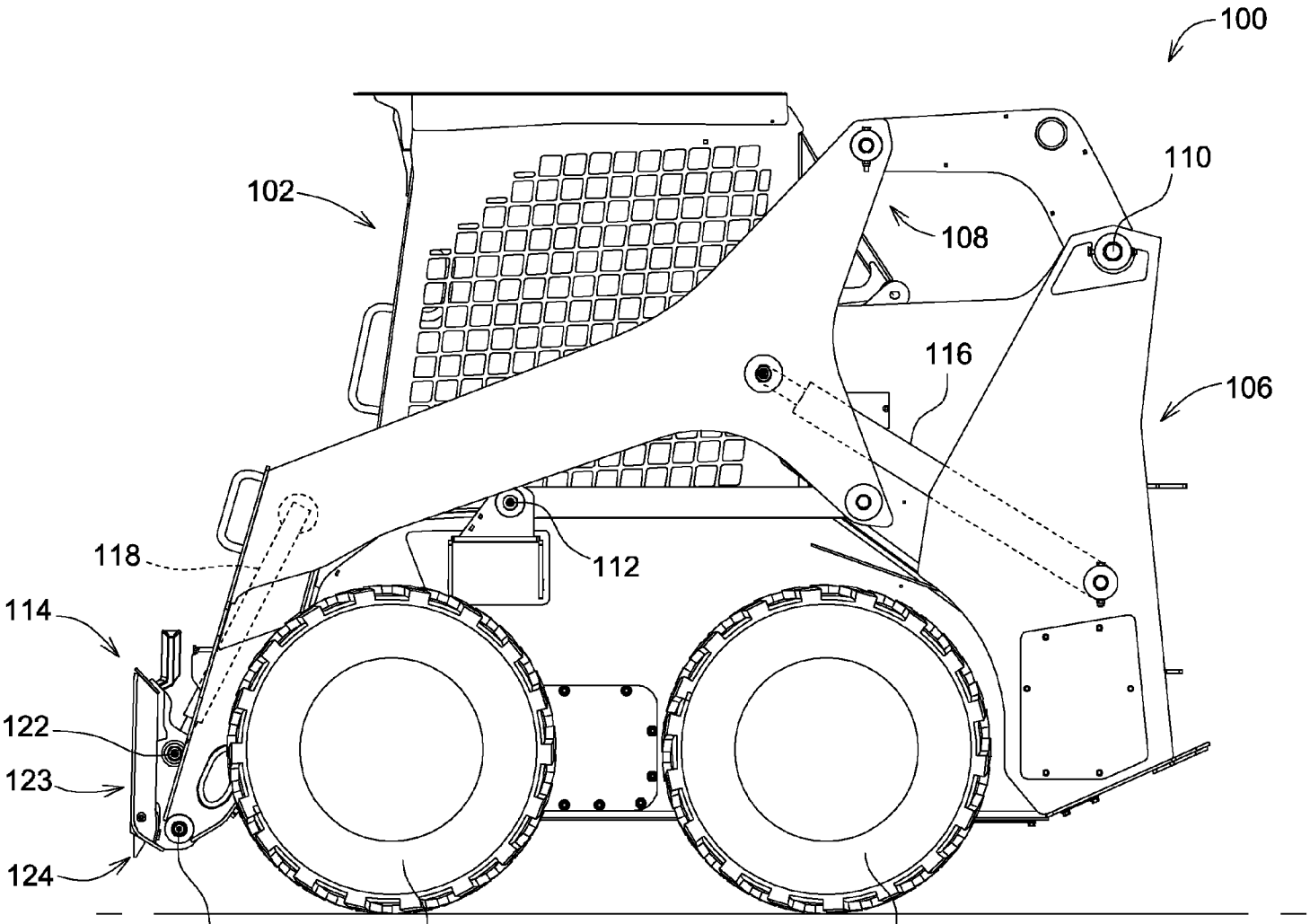
FIG. 1 is a left side view of a work vehicle, for example a skid steer loader, with a coupler connected to the front of the work vehicle.

FIG. 1 is a left side view of work vehicle 100. Work vehicle 100 is illustrated as a skid steer loader, which may also be referred to a skid steer, but may be any work vehicle which may connect to a work tool with a retention assembly, such as backhoe loader, compact track loader, excavator, tractor, tractor loader, and wheel loader, to name a few examples. Work vehicle 100 may perform a number of work operations, including excavating or loading material, shaping or smoothing ground surfaces, excavating or boring a hole, or breaking up a material, to name but a few operations. As used herein, directions with regard to work vehicle 100 may be referred to from the perspective of an operator seated within operator station 102: the left of work vehicle 100 is to the left of such an operator, the right of work vehicle 100 is to the right of such an operator, the front or fore of work vehicle 100 is the direction such an operator faces, the rear or aft of work vehicle 100 is behind such an operator, the top of work vehicle 100 is above such an operator, and the bottom of work vehicle 100 is below such an operator.

Work vehicle 100 is supported on the ground by wheels 104, which provide rolling support to chassis 106 and traction. Chassis 106 provides strength and support to work vehicle 100, and interconnects the components of work vehicle 100, including boom 108. Boom 108, which may also be referred to as a linkage, is pivotally connected to chassis 106 via pins 110 and pins 112. These pivotal connections allow work vehicle 100 to raise and lower boom 108, which in turn raises and lowers coupler 114 and any work tools attached to coupler 114. Work vehicle 100 may raise and lower boom 108 via the extension and retraction of double-acting lift cylinders 116, which may be controlled by a hydraulic control valve supplied with hydraulic fluid from a hydraulic pump. The hydraulic pump may be powered by an engine, such a diesel engine, which may rotate the hydraulic pump and provide power to other functions of work vehicle 100, including to a transmission which drives wheels 104. Coupler 114 may also be tilted relative to boom 108 by tilt cylinders 118, which may allow a work tool attached to coupler 114 to perform a function, such as a bucket which may be tilted upwards to gather material or downwards to dump material.

Coupler 114 is pivotally connected at one longitudinal end of boom 108 via pins 120 and is pivotally connected at one longitudinal end of each of tilt cylinders 118 by pins 122. Coupler 114 may thereby transmit forces between a work tool attached to coupler 114, boom 108, and tilt cylinders 118, allowing the work tool to be raised, lowered, and tilted relative to chassis 106. Coupler 114 includes body 123, the rigid structure which provides strength and carries forces for coupler 114, and retention assembly 124, which aids in retaining and securing a work tool to coupler 114.

In the embodiment illustrated in FIG. 1, body 123 is a weldment where multiple steel components are joined together by welds. In alternative embodiments, body 123 may be configured differently, including as a casting with no welding or joining operations, with components joined by structural adhesives, or with components joined by fasteners, to name but a few examples. Body 123 provides the chassis or rigid structure for coupler 114, and thereby carries the necessary forces, provides rigidity and strength, and provides attachment points for the other components of coupler 114.

Retention assembly 124, described in further detail below, is comprised of multiple interlinked components which allow work tools to be retained in an engaged position with coupler 114, such as when work vehicle 100 is operating with the work tool, or released from engagement, such as when a work tool is being exchanged for another work tool.

Retention assembly 124 may be referred to as engaged, or in an engaged position, when it is retaining a work tool, and may be referred to as disengaged, or in a disengaged position, when it is not retaining a work tool. Retention assembly 124 may also take on positions intermediate to the engaged and disengaged positions, such as occurs when it is being actuated between engagement and disengagement.

Figure 2:
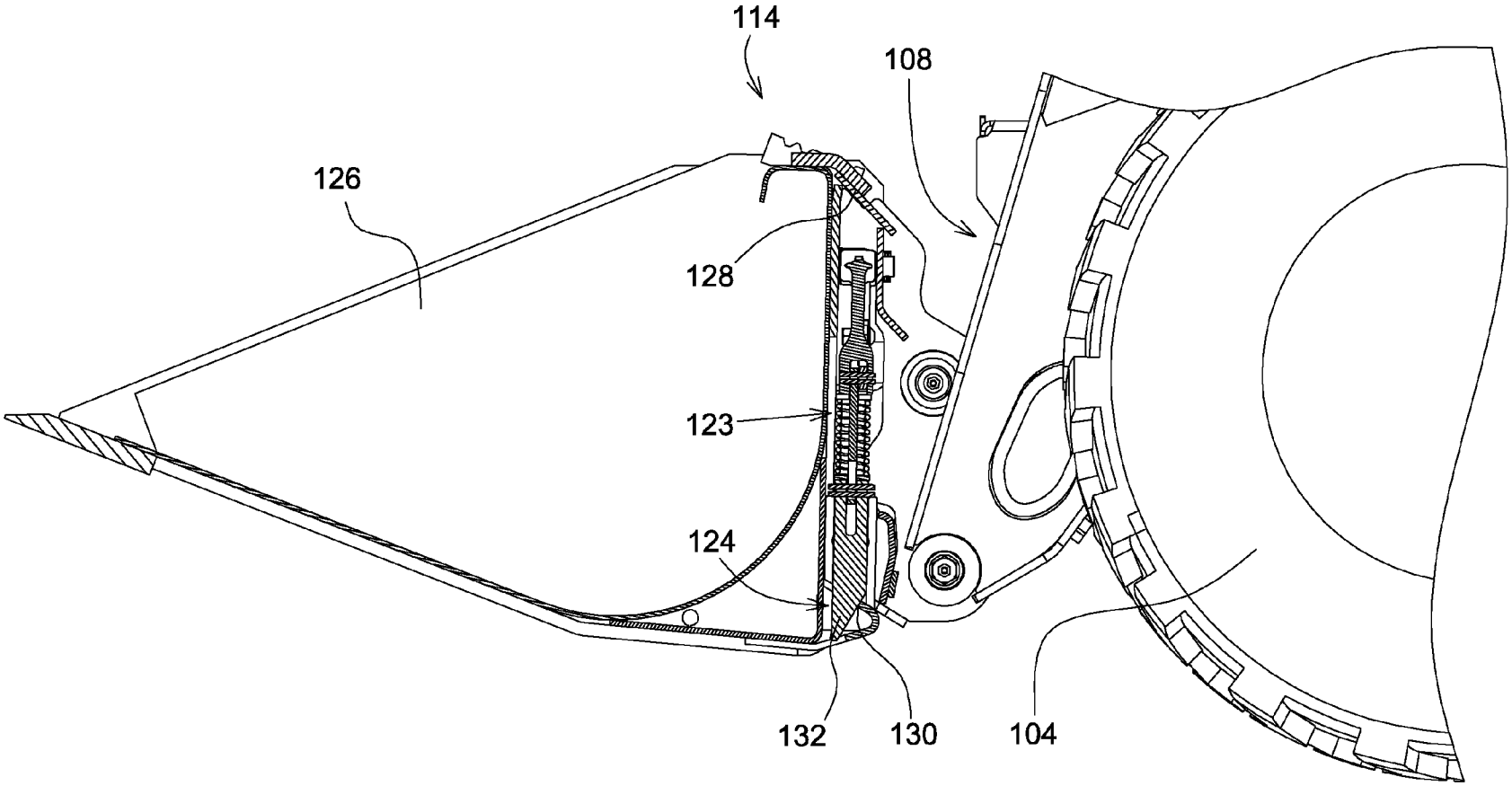
FIG. 2 is a left side view of a portion of the coupler with certain portions removed to allow for a better view of a retention assembly.

FIG. 2 is a left side view of a portion of coupler 114 with certain portions removed to allow for a better view of retention assembly 124. In FIG. 2, work tool 126 is attached to, and being retained by, coupler 114. Work tool 126 is attached to coupler 114 at the front of coupler 114 and retained such that it may be used in a work operation. Work tool 126 is illustrated in FIG. 2 as a bucket, but may also be a blade, forks, a hammer, or any number of other work tools. Work tool 126 is configured such that the shape of its rear surface mates to the front surface of coupler 114. Lip 128 is located on a top end of work tool 126 and is angled downward so as to fit over a mating shape on coupler 114 and act as a tab to prevent the top of work tool 126 from moving in a forwards direction when work tool 126 is attached to coupler 114. Cavity 130 is located at a bottom end of work tool 126 and is shaped to receive retention pin 132 of retention assembly 124, to prevent the forward movement of the bottom work tool 126. In this embodiment, cavity 130 is a hole shaped to receive a pin. Lip 128, cavity 130, and retention pin 132 cooperate to prevent the forward movement of work tool 126 relative to coupler 114, and thereby retain work tool 126 to coupler 114. Although referred to as a "pin," retention pin 132 may be any member which may engage with a mating shape on the work tool so as to retain the work tool and prevent certain motion, such as a pin and cavity, a bar and slot, and a tab/hook and lip/ridge, to name but a few examples.

Figure 3:
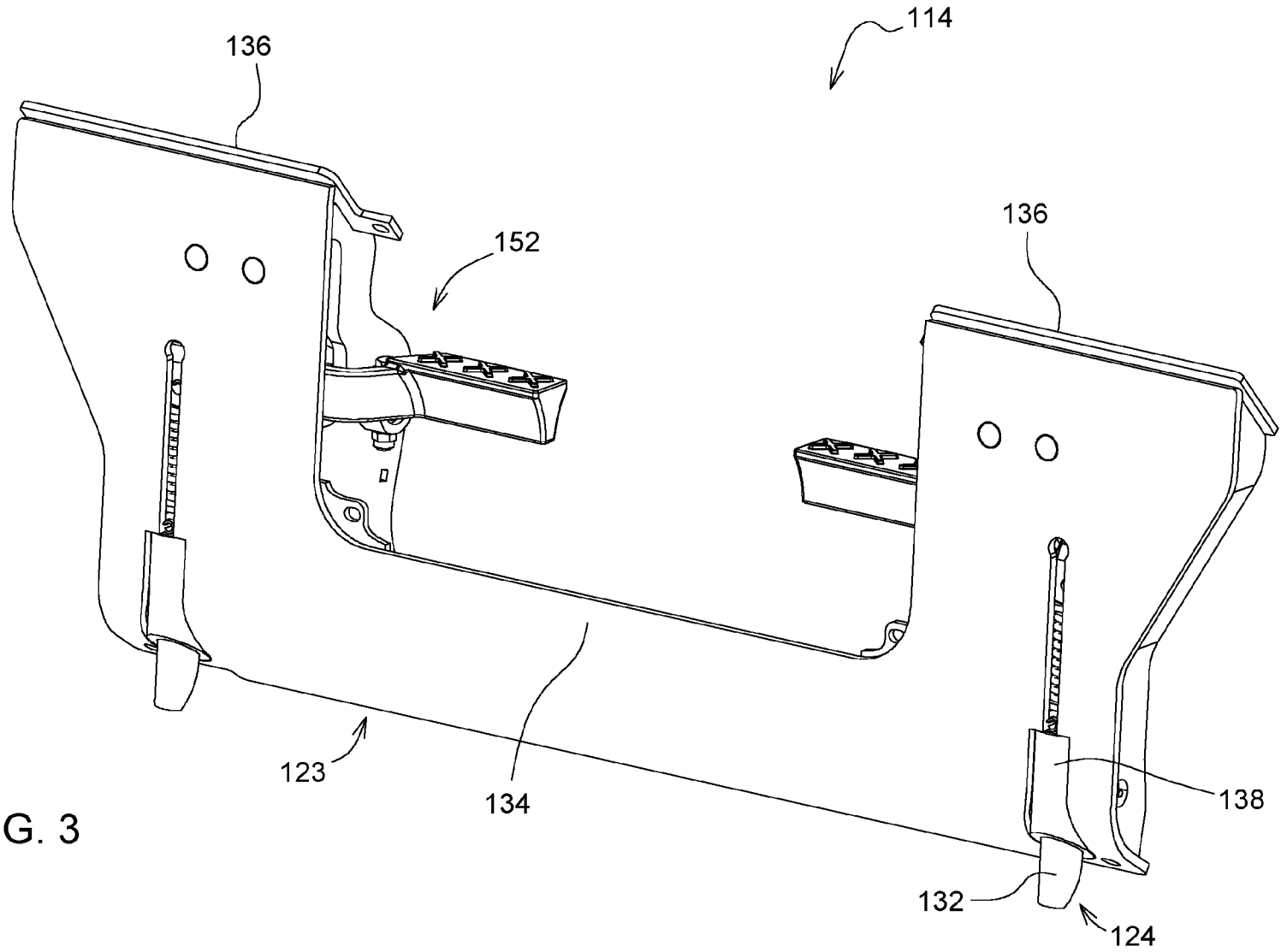
FIG. 3 is a perspective view of the coupler with the retention assembly in an engaged position.
Figure 4:
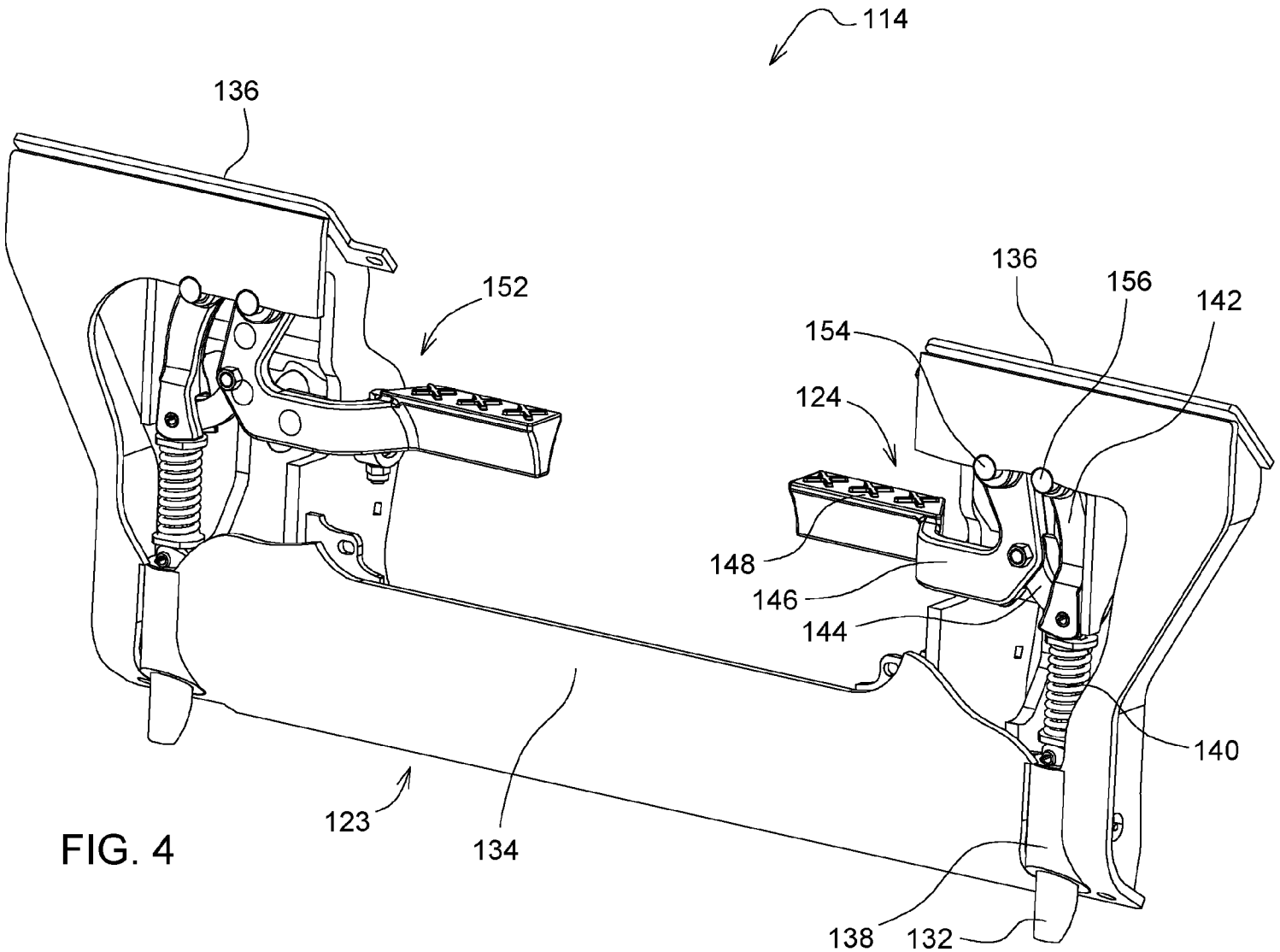
FIG. 4 is a perspective view of the coupler with the retention assembly in the engaged position, with certain portions of the coupler removed to allow for a better view of the retention assembly.

FIG. 3 and FIG. 4 illustrate coupler 114 with retention assembly 124 in an engaged position to retain a work tool against coupler 114. Coupler 114 includes front plate 134 arranged at the front of coupler 114 to act as a surface against which work tool 126 may rest and to act to oppose forces pushing work tool 126 rearward. Top plates 136 are positioned at a top end of coupler 114 and angled downwards and backwards so as to create an acute angle with front plate 134. This shape mates with the shape of lip 128 of work tool 126 to allow work tool 126 to rest on top of coupler 114 while preventing the forward motion of the top of work tool 126 relative to coupler 114. Top plates 136 may also be referred to as forming a ridge, or upward projection, on an upper surface of body 123 of coupler 114 which mates with a slot, or valley or downward projection, on work tool 126 so as to resist forward or rearward movement of work tool 126 relative to coupler 114. Coupler 114 also includes additional members to provide structure, strength, and rigidity, such as a back plate, side plates, gussets, or spacers.

Retention pin 132 of retention assembly 124 protrudes from the bottom of coupler 114 so as to engage with cavity 130 of work tool 126. Retention pin 132 is disposed within a slot of coupler 114, including within boss 138 which is affixed to coupler 114, so as to restrain the majority of the movement of retention pin 132 to movement along the axis of the slot and boss 138. Boss 138 may provide strength and rigidity to oppose forces against retention pin 132 in the forward, backward, left, or right directions. Retention pin 132 traverses boss 138 such that one of its ends is above boss 138. This upper end of retention pin 132 is pivotally connected at one end of first member 140.

First member 140 is pivotally connected at a second end opposite its first end to both second member 142 and third member 144. In alternative embodiments, first member 140, second member 142, and third member 144 may not share a single common pivotal connection, but there may instead be two pivotal connections each of which only pivotally connects two of the three members. In such embodiments, the two pivotal connections may or may not be substantially co-axial. As used in this context, substantially co-axial is intended to mean that the pivotal connections are within typical manufacturing tolerances of being co-axial or are sufficiently co-axial to avoid binding as retention assembly 124 is actuated.

For example, in the embodiment depicted in FIGS. 1-7, first member 140, second member 142, and third member 144 share a common pivotal connection, which in this case is a single pin traversing all three members, which may be referred to as pivot pin. This configuration may also be referred to as first member 140, second member 142, and third member 144 being pivotally interconnected or sharing a common pivotal connection. In alternative embodiments, first member 140 may be pivotally connected to second member 142 via a first pivotal connection and third member 144 may be pivotally connected to one of first member 140 and second member 142 via a second pivotal connection whose axis is offset from the first pivotal connection.

In the embodiment depicted in FIGS. 1-7, second member 142 is pivotally connected at a first end to both first member 140 and third member 144 and a second end opposite the first end to coupler 114. Third member 144 is pivotally connected at a first end to both first member 140 and second member 142 and at a second end opposite the first end to fourth member 146, which may also be referred to as a lever. Fourth member 146 is pivotally connected to coupler 114 at a first end, includes pedal 148 at a second end opposite the first end, and is pivotally connected to third member 144 at a location intermediate to its first end and the second end. Spring 150 is a coil spring which is positioned to encircle first member 140, as first member 140 is within spring 150, and configured so as to exert force in the direction of extension of spring 150.

In the embodiment depicted in FIGS. 1-7, each of the four members (i.e., first member 140, second member 142, third member 144, and fourth member 146) has two pivotal connections which are located at a distance from each other. For first member 140, the pivotal connection between it and retention pin 132 is located at a distance from the pivotal connection between it and second member 142 and third member 144. For second member 142, the pivotal connection between it and first member 140 is located at a distance from the pivotal connection between it and body 123. For third member 144, the pivotal connection between it and first member 140 and second member 142 is located at a distance from the pivotal connection between it and fourth member 144. For fourth member 144, the pivotal connection between it and third member 142 is located at a distance from the pivotal connection between it and body 123. Further, the pivotal connection between body 123 and second member 142 is located at a distance from the pivotal connection between body 123 and fourth member 146.

First member 140, second member 142, third member 144, and fourth member 146 are each rigid components formed from steel, but in alternative embodiments each may formed differently or from different materials. For example, fourth member 146 could be comprised of multiple parts which are attached together, such as an alternative pedal which is bolted to the remainder of fourth member 146.

Second retention assembly 152 may be utilized to provide further retention of work tool 126 to coupler 114. Retention assembly 152 may be a substantially mirror image of retention assembly 124, but positioned on the opposite lateral side of work vehicle 100. This configuration allows coupler 114 to provide two retention pins, one of which may engage a cavity on the left side of a work tool and one of which may engage a cavity on the right side of a work tool.

Figure 5:
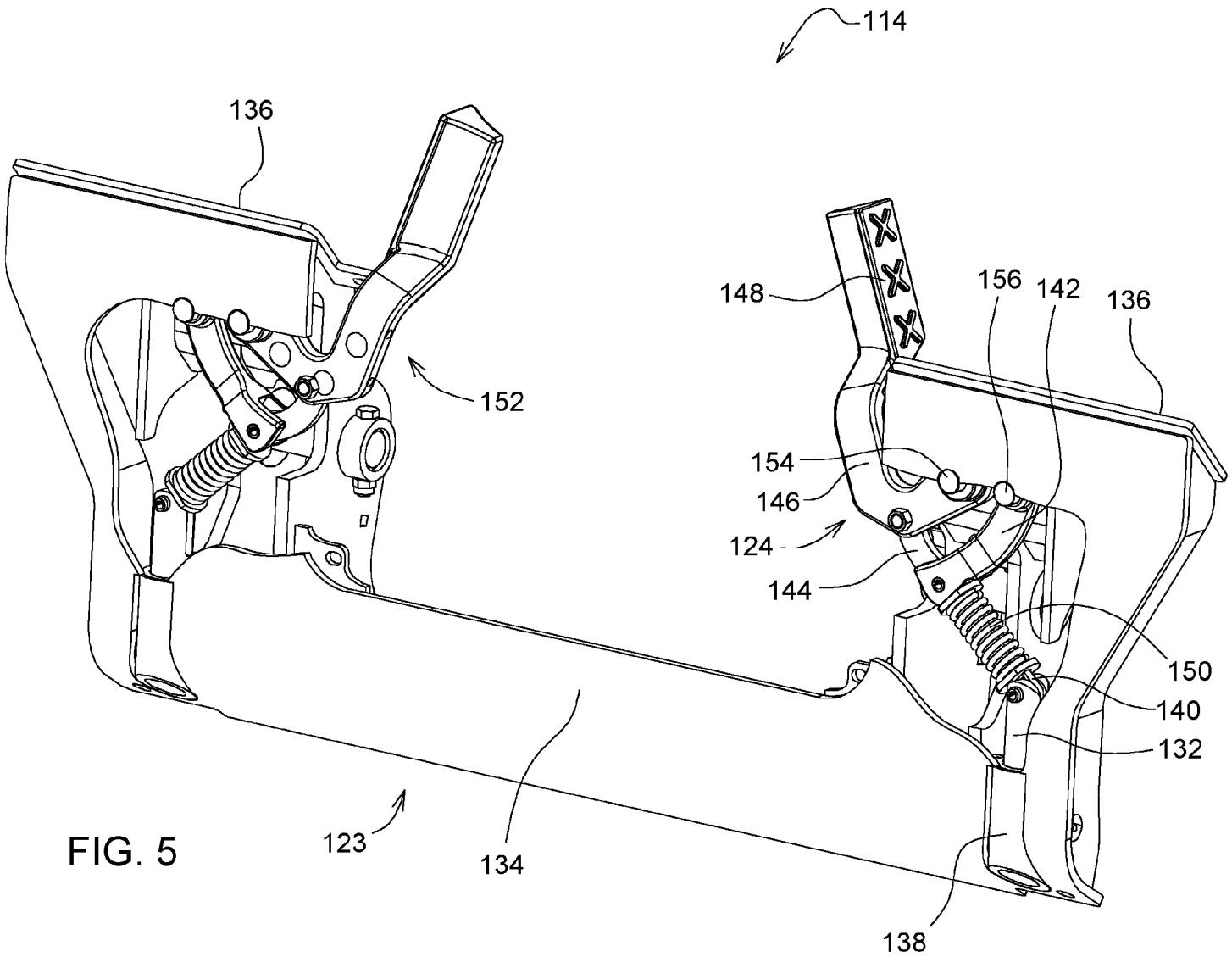
FIG. 5 is a perspective view of the coupler with the retention assembly in a disengaged position, with certain portions of the coupler removed to allow for a better view of the retention assembly.

For retention assembly 124, first member 140, second member 142, third member 144, and fourth member 146 are each rigid structures which cooperate to form a four-bar linkage which allows the actuation of pedal 148 to move retention pin 132 downwards or upwards. As shown by FIG. 4 and FIG. 5, the actuation of pedal 148 from an engaged position (FIG. 4) to a disengaged position (FIG. 5) involves the rotation of pedal 148 and fourth member 146 about pin 154 through which pedal 148 and fourth member 146 are connected to the remainder of coupler 114. When disengaging retention assembly 124, fourth member 146 is rotated counterclockwise when viewed from operator station 102 of work vehicle 100.

As fourth member 146 rotates counterclockwise about pin 154, it pulls third member 144 inward relative to the longitudinal centerline of work vehicle 100, via its pivotal connection with third member 144. This inward movement of third member 144 causes the lower end of second member 142 to move inward, as the lower end of member 142 is pivotally connected to third member 144. The movement of the lower end of second member 142 causes the counterclockwise rotation of second member 142 about pin 156 when viewed from operator station 102 of work vehicle 100.

The counterclockwise rotation of second member 142 about pin 156 causes the upper end of first member 140 to move upward and inward relative to the centerline of work vehicle 100. As first member 140 moves upward and inward, it draws retention pin 132 upward via its pivotal connection with retention pin at its lower end. Retention pin 132 is constrained from moving in other directions by its positioning through boss 138. In this manner, the actuation of pedal 148 can effectuate the vertical position of retention pin 132 and thereby engage or disengage retention pin 132 in cavity 130 of work tool 126.

Fourth member 146 includes pedal 148 which may provide a means for actuation of fourth member 146 by the foot or hand of an operator. Pedal 148 may be shaped with a substantially flat and hatched surface on one side to provide an area for an operator to exert a downward force on fourth member 146 with a foot, but with a smooth or curved area on a second side opposite the first side to provide an area for an operator to exert an upward force on fourth member 146 with a hand. In alternative embodiments, fourth member 146 may be shaped with different surfaces to allow for actuation by an operation, such as a handle to aid in actuation by hand in both directions or a substantially flat surface on both sides to aid in actuation by a foot in both the both directions, or a combination of both so as to permit actuation by hand or foot in either direction. In yet other alternative embodiments, retention assembly 124 may be actuated in non-manual manners, including by hydraulic or electrical actuators configured to exert force on fourth member 146.

Figure 6:
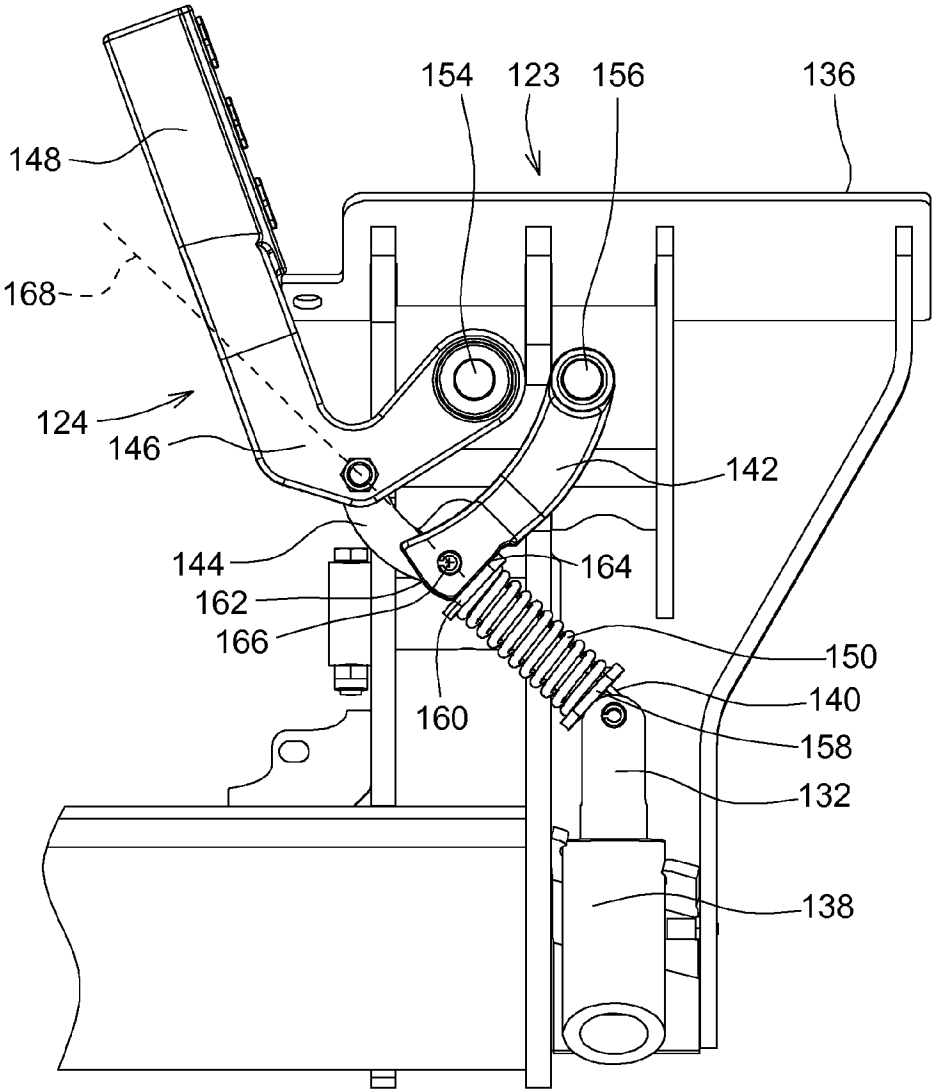
FIG. 6 is a view of the retention assembly in the disengaged position.

FIG. 6 provides a view of retention assembly 124 in the disengaged position. Pedal 148 is rotated fully upward, which in turn results in retention pin 132 being positioned fully upward. In this position, retention pin 132 will not engage cavity 130 of work tool 126, and therefore will not prevent the forward movement of the bottom of work tool 126 relative to coupler 114. With retention assembly 124 is the disengaged position, work tool 126 may be removed from coupler 114 as the bottom of work tool 126 may be rotated away from coupler 114 and work tool 126 may be raised (or boom 108 may be lowered) to disengage lip 128 of work tool 126 from top plates 136 of coupler 114. Another work tool may be then be lowered onto top plates 136 (or boom 108 may be raised) and rotated against front plate 134 so as to align a cavity on the work tool with retention pin 132 so that retention pin 132 may be slidably disposed within the cavity to retain the work tool. Line of action 168 is formed by the axis of the pivotal connection between fourth member 146 and third member 144 and the axis of the pivotal connection between third member 144 and second member 142.

Figure 7:
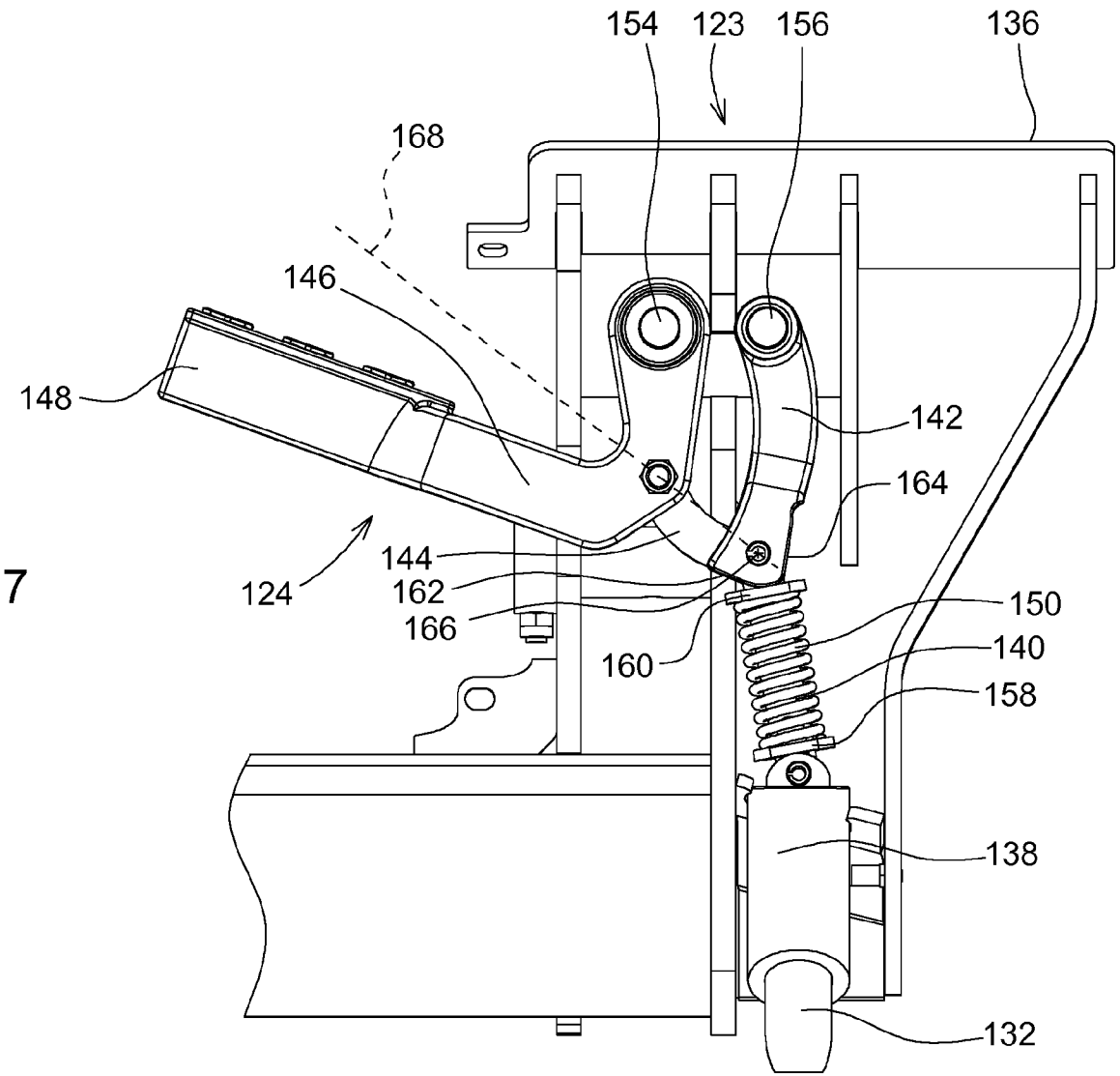
FIG. 7 is a view of the retention assembly in an intermediate position between the disengaged position and the engaged position.
Figure 8:
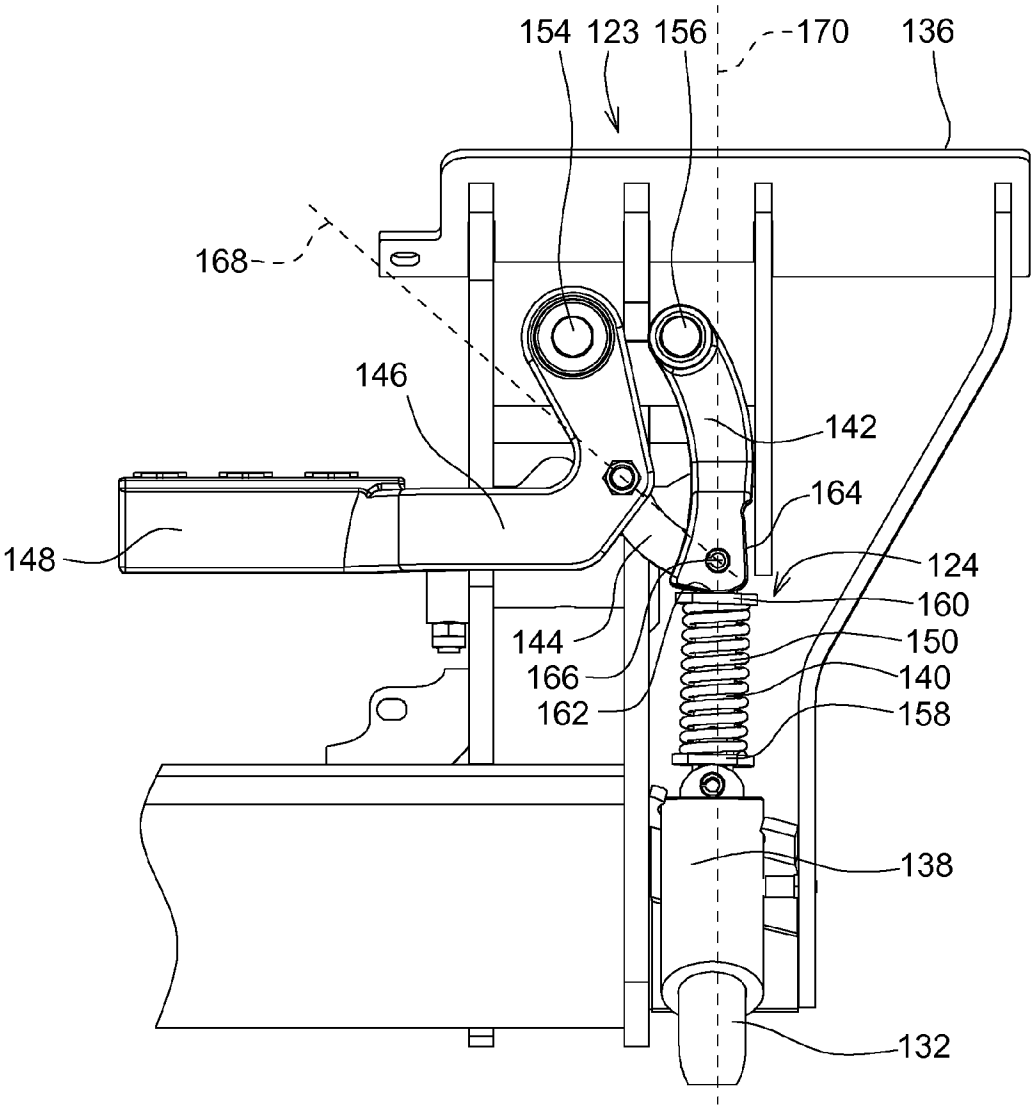
FIG. 8 is a view of the retention assembly in the engaged position.

FIG. 7 provides a view of retention assembly 124 in an intermediate position between the disengaged position (see FIG. 6) and the engaged position (see FIG. 8). As shown by FIG. 7, pedal 148 may be actuated downward to move retention pin 132 downward towards a mating cavity in a work tool. With the continued actuation of pedal 148, retention assembly 124 may reach the engaged position shown in FIG. 8. At this point, the four-bar linkage included in retention assembly 124 has moved retention pin 132 to its engaged position and the four-bar linkage is over center. As can be seen in FIG. 8, upward forces on retention pin 132 will tend to force first member 140 upwards which in turn will force second member 142 to rotate outwards or clockwise when viewed from operator station 102 (counterclockwise in the view of FIG. 8). The over-center configuration can also be seen by reference to line of action 170, which is formed by the axis of the pivotal connection between first member 140 and retention pin 132 and the axis of the pivotal connection between first member 140 and second member 142. Line of action 170 is on the opposite side of the axis of the pivotal connection between second member 142 and body 123, which may be referred to as the axis of pin 156. This over center configuration may prevent upward forces on retention pin 132 from forcing retention assembly 124 to move from an engaged position into a disengaged position, as it generates a force on second member 142 in the opposite direction as that needed to disengage retention assembly 124.

As shown in FIG. 6, FIG. 7, and FIG. 8, line of action 168 does not cross the axis of the pivotal connection between fourth member 146 and body 123, which may also be referred to as the axis of pin 154. Instead, line of action 168 remains on one side of the axis of pin 154 through the actuation range of retention assembly 124, the side opposite the axis of pin 156. This configuration of retention assembly 124 may aid in preventing retention assembly 124 from getting bound or actuated into a state in which it takes increased force to free it, or actuate it into another position.

Spring 150 is compressed between retention pin 132 and second member 142 via plate 158 and plate 160, which provide surfaces to resist movement of spring 150 past the end of retention pin 132 and second member 142, respectively. Plate 160 rides on the end of second member 142, the outer surface of which defines profile 162, which plate 160 engages when second member 142 is rotated outward and retention assembly 124 is in the engaged position, and profile 164, which plate 160 engages when second member 142 is rotated inward and retention assembly 124 is in the disengaged position.

First member 140 pivots relative to second member 142 substantially about axis 166. The distance between plate 160 and axis 166 increases as retention assembly 124 is rotated from the engaged position to the disengaged position, thereby moving plate 160 closer to plate 158 and compressing spring 150, as shown in FIG. 7. This compression of spring 150 provides a force resisting the actuation of pedal 148 to the disengaged position until plate 160 reaches the end of profile 162 and transitions to profile 164, as shown in FIG. 6. This may help maintain retention assembly 124 in the engaged and over-center positions.

Profile 164 is shaped such that plate 160 is closest to axis 166 when retention assembly 124 is in the disengaged position, and gets further from axis 166 as pedal 148 is actuated towards the engaged position. Spring 150 therefore tends to resist the actuation of pedal 148 away from the disengaged position, and helps keep pedal 148 in the disengaged position until sufficient force is exerted on pedal 148 to overcome the additional force caused by the compression of spring 150, at which point plate 160 transitions to profile 162 and the necessary actuation force on pedal 148 decreases.

Plate 160, profile 162, and profile 164 cooperate to form a cam-follower system which allows the amount of force exerted by spring 150 to vary across the actuation range of retention assembly 124, with profile 162 and profile 162 serving as the cam and plate 160 serving as the follower. This configuration may allow for a greater degree of precision in choosing the spring force for each point in the actuation range of retention assembly 124, may reduce the costs and resources necessary to modify the spring force curves as spring 150 may be modified to change the magnitude of the forces and second member 142 may be modified to change the distribution of those forces across the range of actuation, and may reduce the number or complexity of parts necessary to achieve a varying spring force.

The combination of the four-bar linkage of the present disclosure (i.e., the configuration of first member 140, second member 142, third member 144, and fourth member 146) and the cam-follower system of plate 160, profile 162, and profile 164 may permit designs which are easier to use or package. This combination allows for greater control of the force necessary to actuate retention assembly 124 across its entire range of actuation, allowing designs which may better attain design goals which may conflict to some degree with each other (e.g., force on pedal 148 necessary to disengage retention assembly 124, force on pedal 148 necessary to engage retention assembly 124, degrees through which pedal 148 must be actuated to achieve engagement of retention assembly 124, force on retention pin 132 necessary to disengage retention assembly 124). For example, it may be a goal that retention assembly 124 disengages when a certain amount of force is exerted on the end of fourth member 146 (e.g., 200 N) but that complete disengagement requires a certain amount of rotation for fourth member 146 and pedal 148 (e.g., 70 degrees). It may also be desirable to reduce the amount of force necessary to continue actuating fourth member 146 from the engaged position to the disengaged position, and the four-bar linkage and cam-follower system can be configured so as to achieve these design goals.

While the disclosure has been illustrated and described in detail in the drawings and foregoing description, such illustration and description is not restrictive in character, it being understood that illustrative embodiment(s) have been shown and described and that all changes and modifications that come within the spirit of the disclosure are desired to be protected. Alternative embodiments of the present disclosure may not include all of the features described yet still benefit from at least some of the advantages of such features. Those of ordinary skill in the art may devise their own implementations that incorporate one or more of the features of the present disclosure and fall within the spirit and scope of the appended claims.

What is claimed is:

1. A work tool coupler for a work vehicle comprising:

a rigid body;

a retention pin configured to engage a work tool when the coupler is in an engaged position;

a four-bar linkage, comprising:

a first member, the first member pivotally connected to the retention pin, the first member pivotally connected to at least one of a second member and a third member;

the second member pivotally connected to the body and pivotally connected to at least one of the first member and the third member;

the third member pivotally connected to at least one of the first member and the second member;

a fourth member pivotally connected to the body and pivotally connected to the third member; and a pivot pin, the first member, second member, and third member pivotally interconnected via the pivot pin; and a lever attached to the fourth member;

wherein the pivotal connection between the second member and the body is located at a distance from the pivotal connection between the fourth member and the body.

2. The coupler of claim 1, wherein the pivotal connection between the first member and the retention pin is at a first distance from the pivotal connection between the first member and the second member, the pivotal connection between the first member and the second member is at a second distance from the pivotal connection of the second member and the body, the pivotal connection between the second member and the third member is at a third distance from the pivotal connection of the third member and the fourth member, the pivotal connection between the third member and the fourth member is at a fourth distance from the pivotal connection between the fourth member and the body, and each of the first distance, the second distance, the third distance, and the fourth distance are greater than 0inches.

3. The coupler of claim 1, wherein the four-bar linkage is configured such that a line of action formed by the pivotal connection of the third member to at least one of the first member and the second member and the pivotal connection of the third member to the fourth member does not cross an axis about which the fourth member is pivotally connected to the body.

4. The coupler of claim 1, wherein the four-bar linkage is configured such that when the coupler is in the engaged position, a line of action formed by the pivotal connection of the first member to the retention pin and the pivotal connection of the first member to the second member is on the opposite side of an axis about which the second member is pivotally connected to the body as the lever.

5. The coupler of claim 4, wherein the cam is located on at least one of the second member and the third member and the spring extends between the cam and at least one of the first member and the retention pin.

6. The coupler of claim 5, wherein the spring is a coil spring and the first member is located within the spring.

7. The coupler of claim 1, further comprising a spring and a cam, wherein the spring is connected to the linkage via the cam.

8. The coupler of claim 7, wherein the cam and the spring are configured and positioned so that the length of the spring when the coupler is in an intermediate position between the engaged position and a disengaged position is shorter than the length of the spring when the coupler is in the engaged position or the disengaged position.

9. The coupler of claim 1, wherein the lever comprises a means for actuation by hand and a means for actuation by foot.

10. The coupler of claim 9, wherein the retention pin is in a first position when the coupler is in an engaged position, the retention pin is in a second position when the coupler is in a disengaged position, and the retention pin protrudes further below the rigid body in the first position than in the second position.

11. The coupler of claim 10, wherein the first member is positioned within the coil spring.

12. The coupler of claim 10, wherein the cam is shaped such that the compression of the coil spring is greater when the coupler is in an intermediate position between the engaged position and the disengaged position than when the coupler is in the engaged position.

13. The coupler of claim 12, wherein the third surface is closer to the second point than the second surface.

14. The coupler of claim 10, further comprising:

a first surface of the cam positioned between the first point and the second point and in contact with the follower plate when the coupler is in the engaged position;

a second surface of the cam positioned between the first point and the second point and in contact with the follower plate when the coupler is in an intermediate position between the engaged position and the disengaged position;

a third surface of the cam positioned between the first point and the second point and in contact with the follower plate when the coupler is in the disengaged position; and wherein, the first surface is closer to the second point than the second surface.

15. A work tool coupler for a work vehicle comprising:

a rigid body comprising:

a ridge positioned on an upper surface of the body and shaped to mate with a depression on a work tool so as to resist forward and rearward movement of the work tool relative to the coupler;

a slot positioned on a lower surface of the body;

a retention pin positioned within the slot, the retention pin shaped to mate with a hole on a work tool so as to resist movement of the work tool relative to the coupler;

a four-bar linkage, comprising:

a first member pivotally connected to the retention pin about a first point and pivotally connected to a second member and a third member about a second point;

the second member pivotally connected to the body about a third point;

the third member pivotally connected to a fourth member about a fourth point; and the fourth member pivotally connected to the body about a fifth point; and a lever attached to the fourth member.

16. The coupler of claim 15, further comprising:

a cam defined by an outer surface of the second member;

a follower plate in contact with the cam; and a coil spring held in compression by the follower plate.

17. The coupler of claim 15, wherein the four-bar linkage is configured such that when the coupler is in the engaged position, a line of action formed by the first point and the second point is on the opposite side of the second third point as the lever.

* * * * *